US005651315A

United States Patent [19]

Ruckmann et al.

[11] Patent Number: 5,651,315

[45] Date of Patent: Jul. 29, 1997

[54] DEVICE FOR RELEASING PLATES FROM A CYLINDER

[75] Inventors: Wolfgang Günter Ruckmann, Würzburg; Jürgen Alfred Stiel, Thüngen, both of Germany

[73] Assignee: Koenig & Bauer-Albert Aktiengesellschaft, Wurzburg, Germany

[21] Appl. No.: 616,273

[22] Filed: Mar. 15, 1996

[30] Foreign Application Priority Data

Mar. 16, 1995 [DE] Germany ..... 195 09 562.6

[51] Int. Cl.[6] ..... B41F 1/28

[52] U.S. Cl. ..... 101/415.1; 101/409

[58] Field of Search ..... 101/415.1, 409

[56] References Cited

U.S. PATENT DOCUMENTS 3,016,010 1/1962 Luehrs ..... 101/415.1

5,483,891 1/1996 Reichel ..... 101/415.1

FOREIGN PATENT DOCUMENTS 290 623 6/1991 Germany .

42 38 343 5/1994 Germany .

43 03 381 12/1994 Germany .

*Primary Examiner*—Edgar S. Burr

*Assistant Examiner*—Leslie Grohusky

*Attorney, Agent, or Firm*—Jones, Tullar & Cooper, P.C.

[57] ABSTRACT

A plate end of a flexible printing plate is released or ejected from a narrow slit in the surface of a plate cylinder. A rotatable spindle is situated adjacent a radial inner end of the cylinder slit. This spindle carries a group of resilient ejectors having free ends that are engageable with the plate ends during rotation of the spindle and which push the plate ends out of the narrow cylinder slit.

3 Claims, 3 Drawing Sheets

DEVICE FOR RELEASING PLATES FROM A CYLINDER

FIELD OF THE INVENTION

The present invention is directed generally to a device for releasing a plate from a cylinder. More particularly, the present invention is directed to a device for releasing plates having angled or beveled smooth ends from a cylinder. Most specifically, the present invention is directed to a device for releasing the smooth, beveled or angled ends of a plate from a cylinder in a rotary printing press. The plate receiving cylinder is provided with an axially extending, generally radially directed narrow slit into which end legs of the beveled plate ends are insertable. The slit has an inner end which is situated adjacent a pivot lever. A resilient ejector, or several resilient ejectors, are located in The slit and are shiftable in the slit by operation of the pivot lever. Such shifting of the resilient ejector or ejectors in a generally radially outward direction will release the beveled plate ends from the narrow cylinder slit.

DESCRIPTION OF THE PRIOR ART

In the field of rotary printing, it is frequently necessary to attach flexible plates so the surfaces of cylinders. These flexible plates may be printing plates that are attached to printing cylinders, flexible resilient blankets that are attached to blanket cylinders or various spacers or covers that are attached to other press cylinders. Some type of plate end securing assembly is included on the cylinder and is used to engage the plate end or ends and to secure the plate to the cylinder. In order to most effectively utilize the cylinder or roller to which the plate, blanket, sheet or the like is attached, it is important to restrict as little cylinder surface area as possible for the place end securement devices. This has given rise to cylinders that have narrow slits and to plates or blankets with beveled or angled ends having end legs which are received in chose slits. The plate and legs are held in the slits by friction or by clamping or holding assemblies situated within the cylinder. In such devices, it is often difficult to remove the plate from the cylinder in an expeditious manner.

In the German Patent Publication DE 43 03 381 A1 there is disclosed a plate cylinder in a rotary printing press which is provided with a device that is usable to lift a beveled or angled plate end out of a thin slit on the surface of the plate cylinder. This cylinder is provided with a plurality of bores chat are located beneath the printing plate. These bores can be charged with compressed air which will then raise the end of the plate off the surface of the cylinder so that it can be grasped for removal.

A limitation of this prior art device is its utilization of compressed air as the plate end raising mechanism. This requires the supply Of compressed air to the bores, which are located in a cylinder which rotates during its use. This necessitates the provision of elaborate compressed air feed lines to supply the needed compressed air to the cylinder. Such elaborate compressed air feed lines are costly and increase the complexity of the equipment.

A need exists for an arrangement which will facilitate the removal of flexible plates from the surface of a cylinder in a manner that overcomes the limitations of the prior art. The device for releasing planes from a cylinder in accordance with the present invention provides such an arrangement and is a significant improvement over the prior art.

SUMMARY OF THE INVENTION

It is an object of the present invention to provide a device for releasing plates from a cylinder.

Another object of the present invention is to provide a device for releasing plates with beveled ends having end legs from a cylinder of a rotary printing press.

A further object of the present invention is to provide a device for releasing end legs of a flexible plate from a narrow slit in a cylinder.

Still another object of the present invention is to provide a device for releasing at least one beveled or angled end of a flexible plate from a plate cylinder of a rotary printing press.

Yet a further object of the present invention is to provide a device for releasing plates from a cylinder which is simple and requires no connections exterior of the cylinder.

As will be discussed in detail in the description of the preferred embodiment which is presented subsequently, the device for releasing plates from a cylinder is usable to release the leading and/or trailing beveled ends of a plate that is secured to the cylinder. The beveled plate ends have plate end legs which are secured in an axially extending, radially directed narrow slit whose width is only slightly greater than twice the thickness of a beveled plate end leg. A rotatable pivot lever or spindle is situated in the body of the cylinder and has a surface which is generally tangent to a radial inner end of the narrow slit. This spindle carries one or more resilient spring fingers or ejectors that are shiftable radially in the thin slit upon rotation of the pivot lever or spindle. These resilient ejectors have free ends that are engageable with the free ends of the beveled plate end legs and that will push the plate ends out of the narrow slit upon rotation of the pivot lever or spindle in the appropriate direction.

A particular advantage of the present invention is that the beveled end of a plate can be completely removed from the fastening device, such as the narrow slit on the surface of the cylinder. The beveled, flexible plate end that is pushed out of the narrow slit by the action of the resilient ejectors will spring away from the surface of the plate due to its inherent resiliency. Since the plate end springs completely away from the surface of the cylinder, it can be engaged by an automatic plate changing device, for example, without further assistance from the press operator.

Another substantial advantage of the present invention is the elimination of any elements disposed outside of the surface area of the cylinder or which project radially past the surface area of the cylinder. The resilient ejectors of the present invention move entirely within the narrow slit that receives the beveled plate end legs. Therefore, no additional space is required in the area of the surface of the cylinder for the device in accordance with the present invention. The maximum surface area of the cylinder is thus available for printing or for other intended cylinder functions and is not restricted by bores or movable strips in the surface area of the cylinder beneath the flexible plate or blanket.

It will thus be seen that the device for releasing plates from a cylinder in accordance with the present invention overcomes the limitations of the prior art devices. The device of the present invention is a substantial advance in the art.

BRIEF DESCRIPTION OF THE DRAWINGS

While the novel features of the device for releasing plates from a cylinder in accordance with the present invention are set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
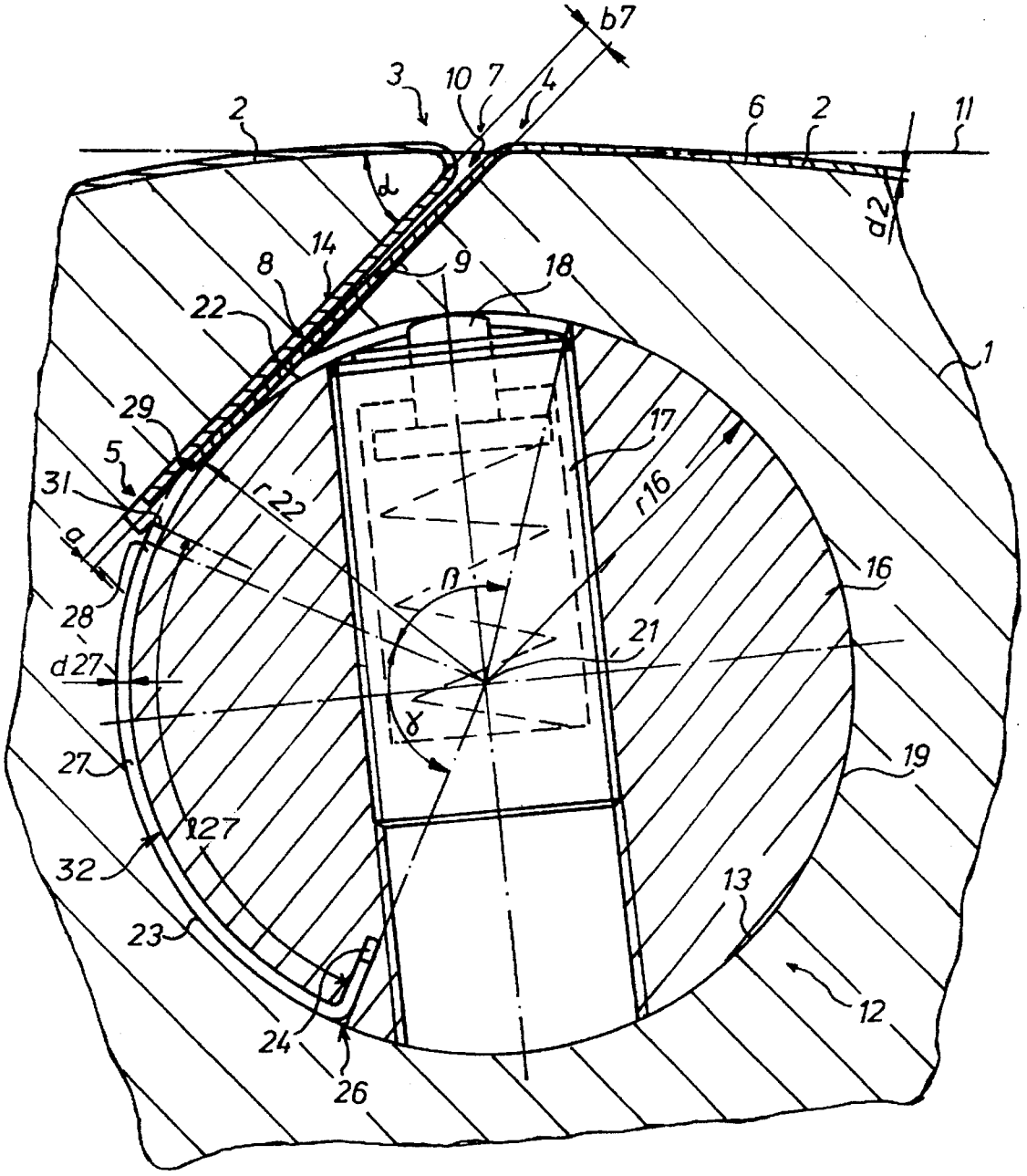
FIG. 1 is a schematic sectional view of a portion of a cylinder in a rotary printing press and showing the device for releasing plates from the cylinder in accordance with the present invention in the plate insertion position.
Figure 2:
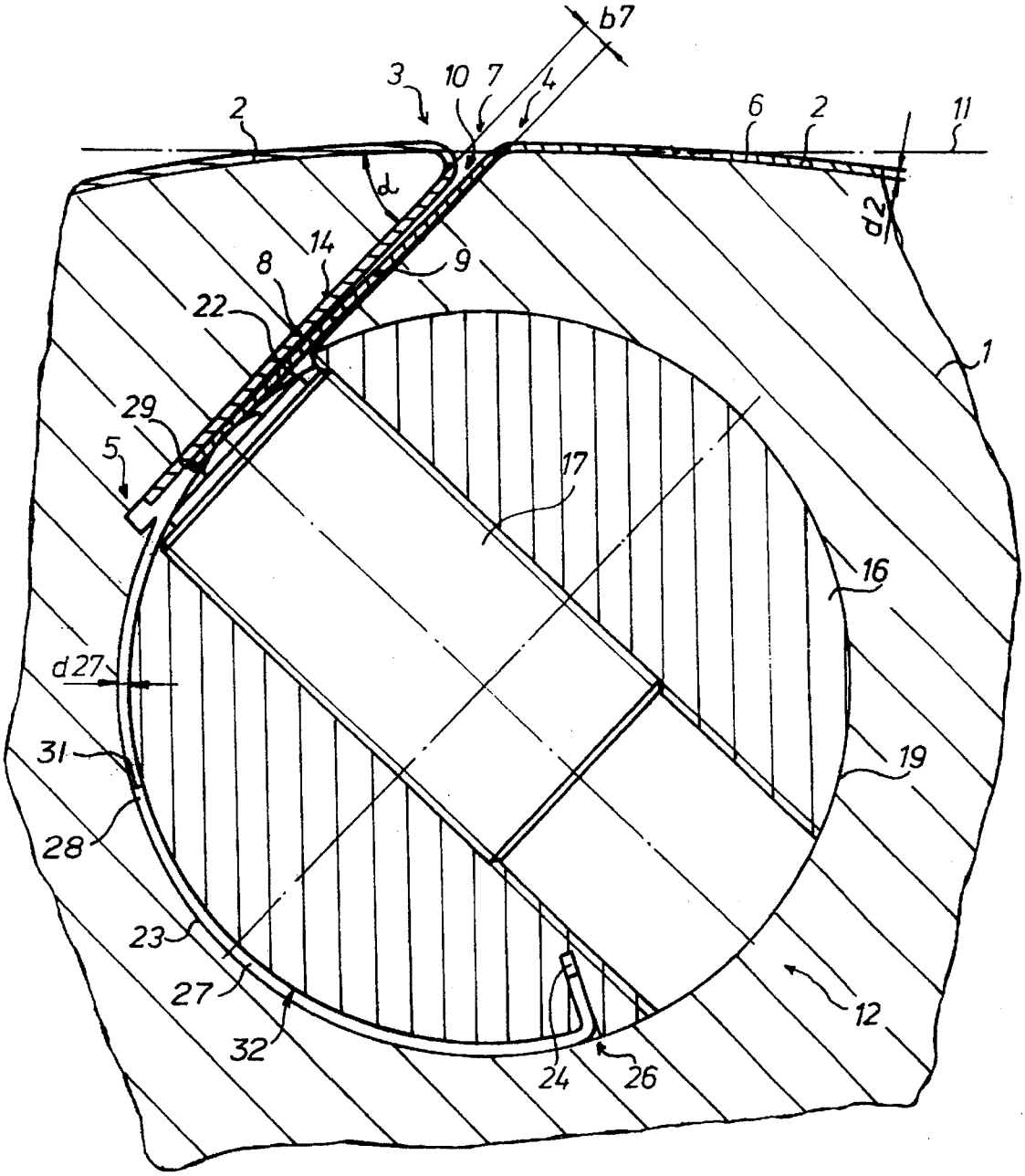
FIG. 2 is a view similar to FIG. 1 and showing the device in the clamping position.
Figure 3:
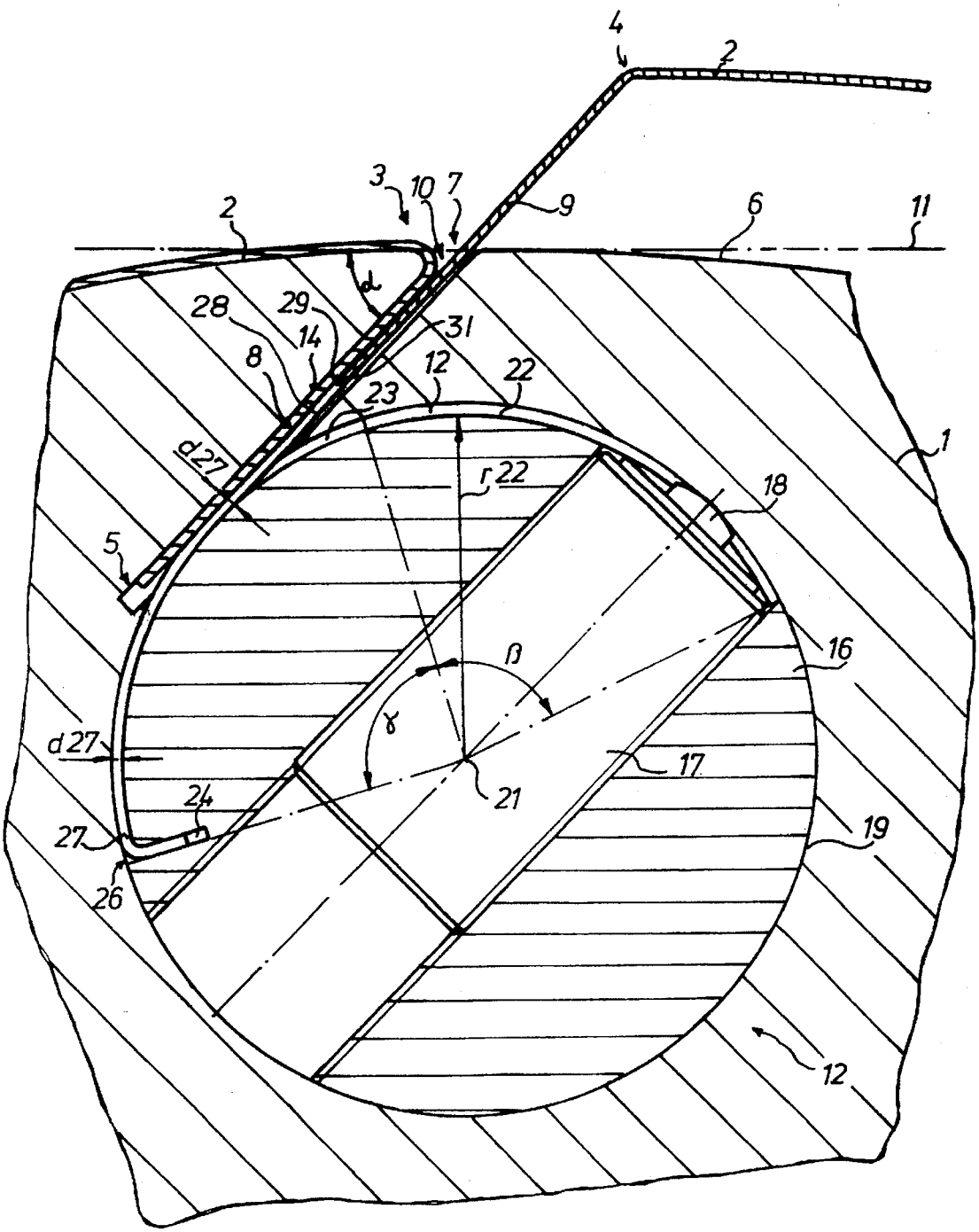
FIG. 3 is a view similar to FIGS. 1 and 2 and showing the device in the ejection position.

Referring initially to FIG. 1, and also referring to FIGS. 2 and 3, there may be seen at 1 a portion of a cylinder which is a part of a rotary printing press and in which the device for releasing plates in accordance with the present invention is situated. It will be understood that cylinder 1 is a plate cylinder that forms part of a rotary printing press. Cylinder 1 could also be a resilient blanket cylinder or another the of cylinder which is utilized in a rotary printing press. The overall structure of the cylinder 1 and of the rotary printing press form no part of the subject invention and are thus not described in detail.

Cylinder 1 is structured to receive flexible printing plates 2 on its surface 6 and is provided with at least one axially extending, generally radially directed thin slit 7 that extends generally radially inwardly in an interior portion 5 of cylinder 1 from a slit outer end 10 at the surface 6 of the cylinder 1. The flexible printing plate 2, that is situated on the surface 6 of the cylinder 1, is provided with leading and trailing beveled or angled ends 3 and 4, respectively. As may be seen in FIGS. 1–3, these leading and trailing beveled plate ends 3 and 4 have leading and trailing end legs 8 and 9, respectively which are receivable in narrow slit 7 when flexible plate 2 is positioned on the surface 6 of the cylinder 1.

The flexible plate 2 has a plate thickness d2 of, for example, d2=0.3 mm. This plate, as discussed above, is preferably a printing plate. It may also be a support plate with a rubber blanket fastened to it, or may be another type of plate usable in a rotary printing press. The leading end 3 of the plate has a leading end leg 8 while the trailing end 4 has a trailing end leg 9. In the plane 2 depicted in the drawings, the leading end leg 8 is longer than the trailing end leg 9 of the plate 2.

As may be seen in FIGS. 1–3, the narrow slit 7 is preferably generally rectangular in cross-section. The cylinder slit 7 has a width b7 at its outer end 10 which is slightly greater than twice the thickness d2 of the plate 2. Thus b7=1 mm, for example. The slit 7 is inclined at an angle of inclination $\alpha$ of generally 45° with respect to a line 11 which is tangent to the surface 6 of the cylinder 1 at the location of the slit 7.

An axially extending bore 12 is formed in the cylinder 1 and extends parallel with the cylinder slit 7. An inner end of the slit 7 is in contact with the bore 12 and forms a chord with respect to the bore 12. In the subject invention, there is a vertical continuation of a surface area 13 of the bore 12 at a distance "a" in respect to a lateral face 14 of the slit 7 facing away from the bore 12. This distance "a" is slightly greater than the thickness d2 of the plate 2. For example, a=0.4 mm.

A pivot lever 16 which, in the subject invention, is configured as a spindle 16 having a radius r16 of, for example, r16=15 mm, is seated in the bore 12. The pivot lever or spindle 16 is centered in the cylinder bore 12 and is rotatable with respect to the cylinder 1 in the bore 12. A plurality of redially outwardly acting pressure elements, generally at 17, are axially spaced along the length of the spindle 16. These pressure elements 17 are secured in the spindle 16 in such a way that pressure cams 18, which are part of the pressure elements 17, can resiliently act or extend radially outwardly beyond a circumferential surface 19 of the spindle 16.

As may be seen in each of FIGS. 1 and 3, the circumferential surface 19 of the spindle 16 is discontinuous about its circumferential length. In the area of radially outwardly acting pressure elements 17, the surface area 19 of the spindle 16 has a surface area portion 22 of a reduced radius r22 in which r22=14.5 mm. This continuous reduced radius surface area portion 22 has a arcuate length $\beta$ of generally 80° with respect to a longitudinal axis 21 of the spindle 16. This is followed, as may be seen in the drawings, by a second discontinuous reduced diameter portion 32 extending over an angle $\gamma$ of generally 90° in which this second reduced surface area 32, viewed in the axial direction of the spindle 16, is only partially provided in the form of one or of a plurality of axially spaced generally U-shaped grooves 23 which each extend in the circumferential direction of the spindle 16. Thus the reduced diameter portion of the spindle 16 has a first continuously reduced diameter portion 22 and a second discontinuous reduced diameter portion. This second, discontinuous reduced diameter portion 32 formed by the one or the plurality of U-shaped grooves 23 terminates in an axially extending spindle surface channel or slot 24 that is cut into spindle 16 and which extends radially inwardly into the spindle 16 from its surface 19.

A resilient ejector 27 is situated in each of the U-shaped grooves 23 formed in the spindle 16, A first end 26 of each resilient ejector 27 is positioned in the spindle channel 24. These resilient ejectors 27 are made of a flexible elastic but pressure resistent material and in the preferred embodiment are leaf springs made of spring steel. Each of these ejectors has a length 127 of, for example, 127=25 mm. Each ejector is sized to be receivable in its cooperating U-shaped groove 23 on the discontinuous reduced diameter portion 32 of the spindle 16. The length 127 of each spindle is sufficient to bring a free second end 28 of each ejector 27 into the first, continuous reduced diameter portion 22 of the spindle 16. Each ejector 27 has a thickness d27 wherein d27=0.5 mm, for example.

The operation of this device for releasing plates from a cylinder in accordance with the present invention will now be discussed in detail. With the cylinder 1 in a plate end insertion position, as depicted in FIG. 1, the spindle 16 has been rotated so that its first, continuous reduced diameter portion 22 is generally adjacent the inner end of the cylinder slit 7. This situates the resilient ejectors 27 beneath or radially inwardly of the slit 7 and the pressure elements 17 out of contact with the cylinder slit 7. In this plate end insertion position, the beveled plate end legs 8 and 9 can be inserted into the slit 7 with the continuous reduced area 22 of the spindle 16 acting as a guide. As soon as the beveled plate end legs 8 and 9 have been fully inserted into the cylinder slit 7 and the flexible plate 2 has been pressed against the surface 6 of the cylinder 1, the spindle 16 will be rotated in a counterclockwise direction into the clamping position which is depicted in FIG. 2. This counterclockwise rotation of the spindle 16 will locate the pressure elements 17 so that they are generally perpendicular with the plate end legs 8 and 9 and so that their pressure cams 18 will bear against the legs 8 and 9 of the beveled plate ends 3 and 4. These pressure cams 18 may be pressed against the plate end legs 8 and 9 by the force of suitable springs which are carried within the pressure elements, as is depicted in a somewhat schematic fashion in the drawings. This cooperation of the pressure elements 17 carried by the spindle 16 with the end legs 8 and 9 of the plate 2 is effective to securely clamp the flexible plate 2 onto the surface of the cylinder 1. The ends 3 and 4 of the plane 2 are clamped in the narrow slit 7 of the cylinder 1 by the action of the pressure cams 18 which stretch and pull the plate end legs 8 and 9 radially inwardly into the cylinder slit 7. Once the spindle 16 has been turned to the clamped position depicted in FIG. 2, it can be stopped and retained in that position.

Referring now primarily to FIG. 3, when it is desired to release the plate ends 3 and 4 from the narrow slit 7, the spindle will be rotated in a clockwise direction into a plate end ejection position. As the spindle 16 is rotated in this clockwise direction, the pressure elements 17 will move out of contact with the legs 8 and 9 of the plate ends 3 and 4 to thus release the plate ends. This rotation of the spindle 16 brings the pressure elements 17 into the portion of the cylinder bore 12 in which the pressure cams 18 engage the surface 13 of the cylinder bore 12. As the spindle 16 is continued to be rotated in the clockwise direction, the free ends 28 of the resilient ejector 27 will now reach the area of the trailing end 4 of the flexible plate 2. As is shown in FIG. 3 a first face 31 of each ejector free end 28 will abut a front end face 29 of the leg 9 of the trailing plate end 4 and will exert a radially outwardly directed force against it. As the spindle 16 is continued to be rotated in a clockwise direction, the resilient ejectors 27 spring out of their U-shaped grooves 23 and extend upwardly into the narrow cylinder slit 7. This positions the free ends 28 of the ejectors generally tangentially with respect to the spindle 16 with the ejector free ends 28 extending toward the outer end 10 of the slit 7. The spindle 16 is rotated in its clockwise direction until the free end 28 of each of the resilient ejectors 27 is situated just beneath, but closely adjacent to the surface 6 of the cylinder 1. This has the effect of completely removing the trailing end 4 of the flexible plate 2 from the narrow cylinder slit 7. The inherent resiliency of the flexible plate 2 and its intrinsic tension will act to cause the plate trailing end 4 to spring out of the cylinder slit 7 once it has been moved to the ejection portion depicted generally in FIG. 3.

While the device for releasing plates from a cylinder in accordance with the present invention has been discussed hereinabove as utilizing a plurality of individual resilient ejectors 27 disposed in U-shaped grooves 23, it would also be possible to utilize only one resilient ejector acting on the trailing end leg 9 of the plate. Such a single resilient ejector would have a width corresponding generally to the width of the plate 1 and would require the provision of a single, axially extending second reduced diameter portion of the spindle 16 instead of the previously discussed plurality of U-shaped grooves 23.

In accordance with the present invention, it would also be possible to structure the resilient ejector 27 so that they would engage both of the plate ends 3 and 4. It would also be possible to provide a separate ejection device for each plate end 3 and 4.

While a preferred embodiment of a device for releasing plate ends from a cylinder in accordance with the present invention has been set forth fully and completely hereinabove, it will be apparent to one of skill in the art that a number of changes in, for example, the overall size of the cylinder, the type of printing being done by the printing press, the drive for the press and the like could be made without departing from the true spirit and scope of the present invention which is accordingly to be limited only by the following claims.

What is claimed is:

1. A device for releasing plates having beveled smooth plate end legs from a cylinder of a rotary printing press comprising:

a narrow slit extending axially along said cylinder and directed generally radially into said cylinder from an outer surface of said cylinder to a slit inner end, said slit being adapted to receive said plate end legs and having a width at said outer surface of said cylinder slightly greater than twice a thickness of a plate end leg;

an axially extending bore in said cylinder, said bore having a bore surface, said slit forming a chord with said bore surface;

a pivot spindle rotatably supported in said bore, said pivot spindle having a circumferential surface which contacts said bore surface, said pivot spindle being rotatable in said bore between a plate end leg clamping position and a plate end leg ejection position;

at least a first circumferentially extending groove on said pivot spindle circumferential surface; and at least a first resilient ejector, said ejector having a first end secured to said pivot spindle, said resilient ejector being received in said groove in said pivot spindle circumferential surface and engaging said bore surface, said resilient ejector having a second end, said second end being retracted beneath said slit inner end when said pivot spindle is rotated to said plate end leg clamping position and being inserted into said slit and into contact with a front face of at least one of said plate leg ends when said pivot spindle is rotated to said plate end leg ejection position.

2. The device of claim 1 wherein said ejector is made of a resiliently flexible, material.

3. The device of claim 2 wherein said ejector is spring steel.

* * * * *